US005601101A

United States Patent [19]

Grapes et al.

[11] Patent Number: 5,601,101

[45] Date of Patent: Feb. 11, 1997

[54] WASHING SYSTEMS

[75] Inventors: Robert D. Grapes; Mark R. Bell-Booth, both of Palmerston North, New Zealand

[73] Assignee: Precision Dispensing Systems Limited, New Zealand

[21] Appl. No.: 379,533

[22] PCT Filed: Aug. 4, 1993

[86] PCT No.: PCT/NC93/00063

§ 371 Date: Jan. 31, 1995

§ 102(e) Date: Jan. 31, 1995

[87] PCT Pub. No.: WO94/03286

PCT Pub. Date: Feb. 17, 1994

[30] Foreign Application Priority Data

Aug. 4, 1992 [NZ] New Zealand ..... 243834

[51] Int. Cl.[6] ..... B08B 13/00

[52] U.S. Cl. ..... 134/56 R; 134/99.2; 134/100.1; 134/113

[58] Field of Search ..... 134/100.1, 99.2, 134/99.1, 56 R, 57 R

[56] References Cited

U.S. PATENT DOCUMENTS

| | | | |
|---|---|---|---|
| 3,595,268 | 7/1971 | Archer | 134/99.2 |
| 3,829,024 | 8/1974 | Heden | 134/99.2 |
| 4,756,321 | 7/1988 | Livingston et al. | 134/99.2 |
| 4,915,119 | 4/1990 | Franklin | 134/100.1 |
| 4,925,495 | 5/1990 | Crisp et al. | 134/56 R |
| 5,020,917 | 6/1991 | Homan | 134/100.1 |
| 5,107,873 | 4/1992 | Clinger | 134/56 R |
| 5,195,203 | 3/1993 | Blom et al. | 134/99.2 |

*Primary Examiner*—Frankie L. Stinson

*Attorney, Agent, or Firm*—Blakely Sokoloff Taylor & Zafman

[57] ABSTRACT

A washing system for in place washing of a machine or equipment. The washing system includes a supply valve arrangement (21) that is connectable to at least one source (16) of washing fluid, wherein the valve arrangement is operable to regulate a flow of washing fluid to the machine or equipment to be washed. A doser unit (10) having a linear actuator (14) is coupled through a valve (26) to a source (24) of cleaning additive. A control unit (29) is coupled with the valves (21, 26) and the doser unit (10) via a sensor (27) such that controlled changes in the flow of washing fluid and the addition of cleaning additive to the washing fluid can be effected. When the supply is formed by two sources of washing fluid, one source is at a higher temperature than the other. The control unit (29) is further able to change the pressure of the flow of washing fluid to the machine or equipment such that controlled changes in the pressure can be effected.

13 Claims, 4 Drawing Sheets

WASHING SYSTEMS

Figure 1:
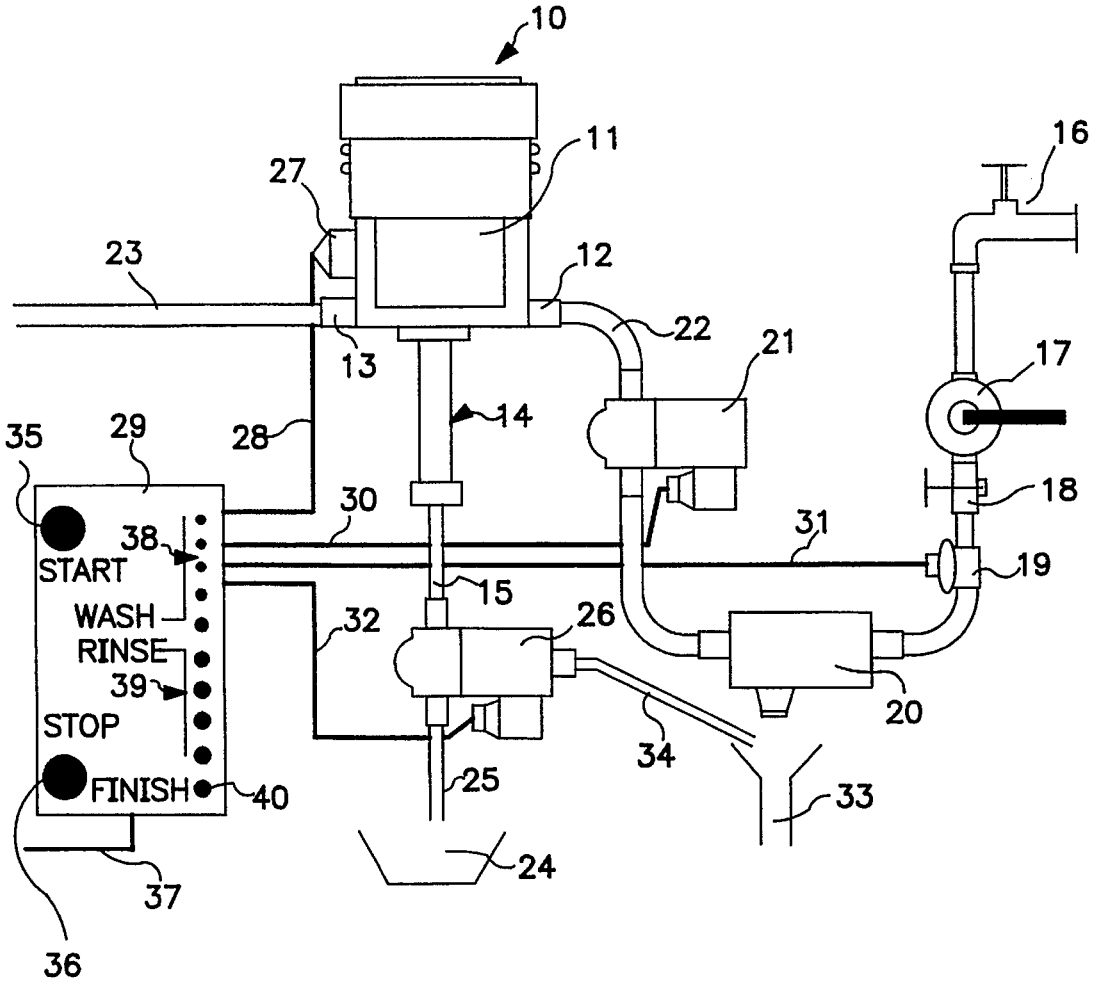

This invention relates to washing systems and more particularly a clean in place washing system.

There are situations where regular in place washing of equipment is required in order to maintain it in a clear and hygienic state. For example, in hotels, taverns, bars (both private and public), aerated waters, beers, ales etc are delivered under pressure from a bulk supply (such as pressurized kegs) to dispensing taps, guns or the like. The delivery lines need to be regularly cleaned to ensure that they are kept clear and the required levels of hygiene are maintained. This cleaning is generally carried out by flushing the lines with a mixture of a washing concentrate (e.g. caustic soda) and water from a pressurized container followed by clean water flushing.

While this system does effectively clean the delivery lines it is not a straight forward operation which can be readily carried out by bar management or staff. Thus it is an operation usually carried out by a manufacturer's representative visiting the establishment. Therefore it is quite often the case that the operation is not carried out as regularly as is desirable.

Also regular cleaning of liquid food dispensing equipment (such as, for example, Taylor Dairy Machines which dispense milk shakes and soft freeze ice cream) is required to keep the equipment clean and free of bacterial contamination. With such equipment, however, there are a large number of components which need to be manually dismantled and cleaned. These include milk feed pump(s) and the draw valve assembly. The operation of cleaning is thus one which takes a considerable amount of time to carry out. It therefore involves in many situations considerable expense to the owner/operator of the equipment.

Accordingly the present invention has as one of its main objects the provision of a washing system for in place washing of beverage and/or foodstuff dispensing equipment, the washing system being effective in use and easy to operate.

Broadly therefore in one aspect of the invention there is provided a washing system comprising a doser unit connectible with a washing fluid supply, said doser unit being connected to a cleaning additive supply and having means for supply of metered quantity of cleaning additive to the doser unit, sensing means for, in use, sensing the number of operations of the doser unit when said doser unit is metering cleaning additive into the washing fluid supply and control means for causing disconnection of the cleaning additive supply from the doser unit after a predetermined number of operations of the doser unit has been sensed by said sensing means.

In the preferred form of the invention the doser unit is a volumetric hydraulic pump. Preferably the sensing means is an external sensor coupled with the body or housing of the doser unit and can in one form be provided by an acoustic coupler.

According to a further broad aspect of the invention there is provided a washing system for in place washing of a machine or equipment the system including supply means connectible to at least one source of washing fluid and operable to regulate a flow of said washing fluid to the machine or equipment, means for adding a cleaning additive to the washing fluid, and control means for controlling said supply means whereby controlled changes in the flow of washing fluid to the machine or equipment can be effected.

The present invention also provides a washing system for in place washing said system including a doser unit for supply into washing liquid of a cleaning additive characterised in that it includes external sensing means which senses movement of an internal component or componentry of the doser unit such movement being correlated to a metered dosage being dispensed.

Figure 2:
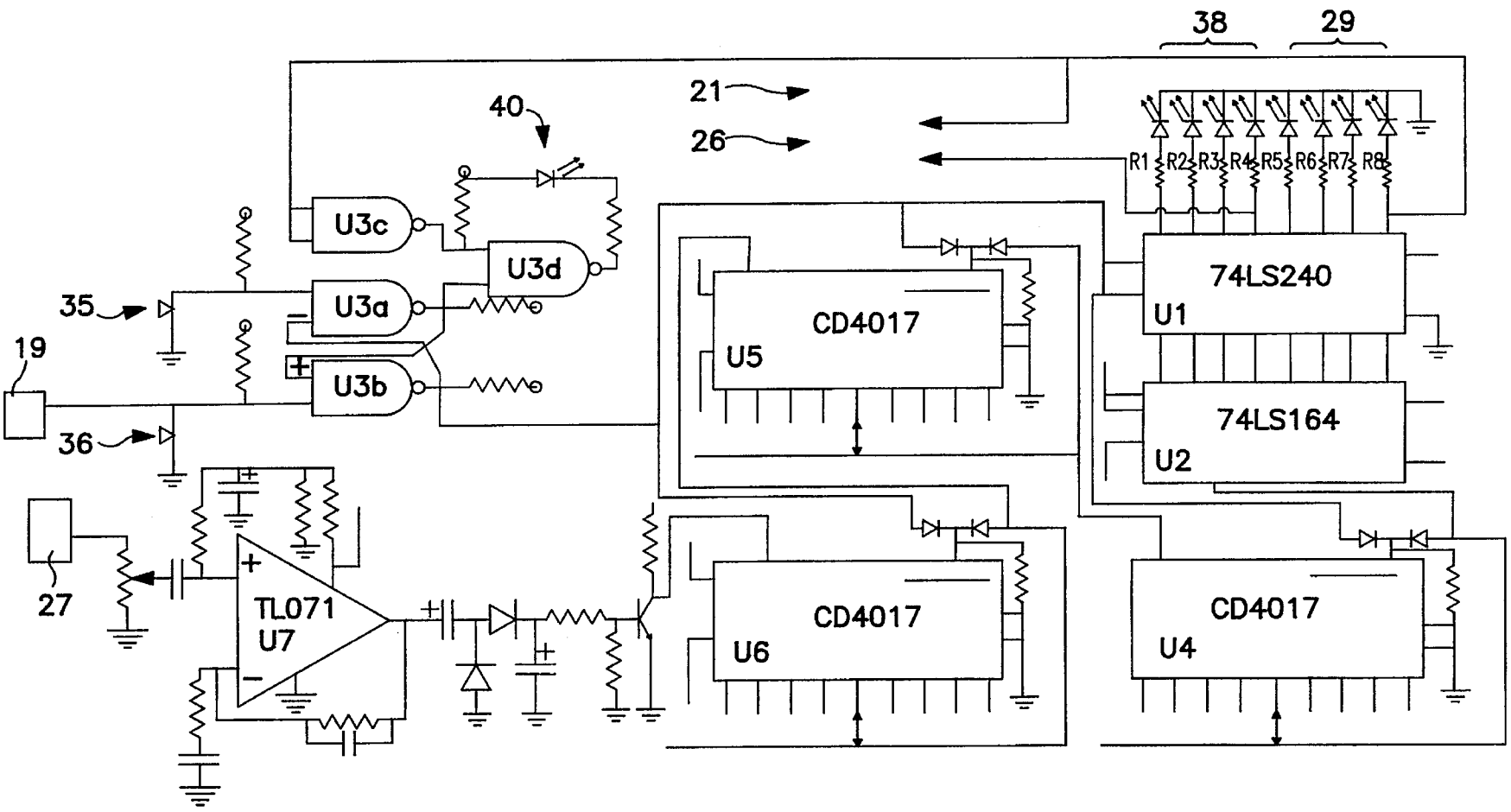
Figure 3:
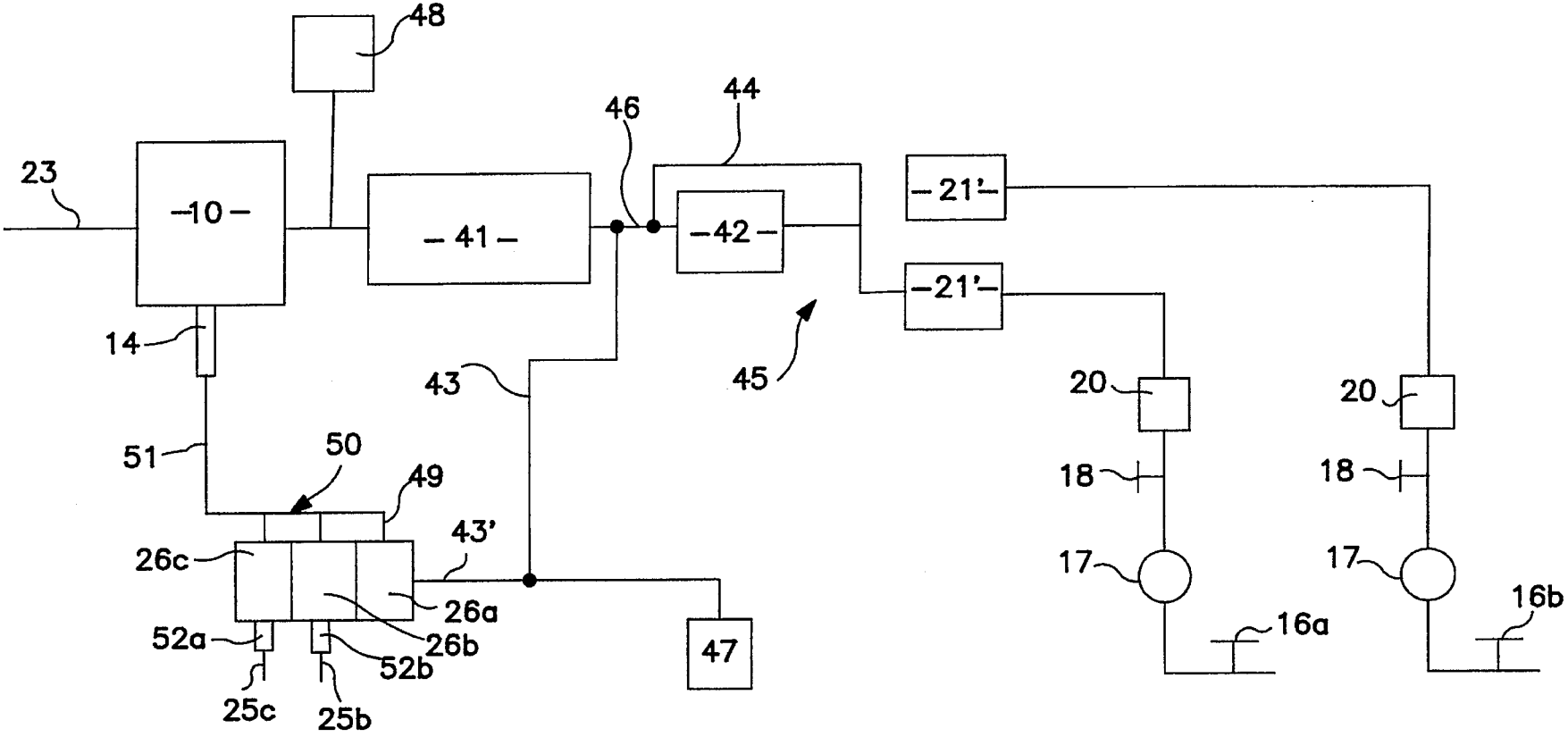
Figure 4:
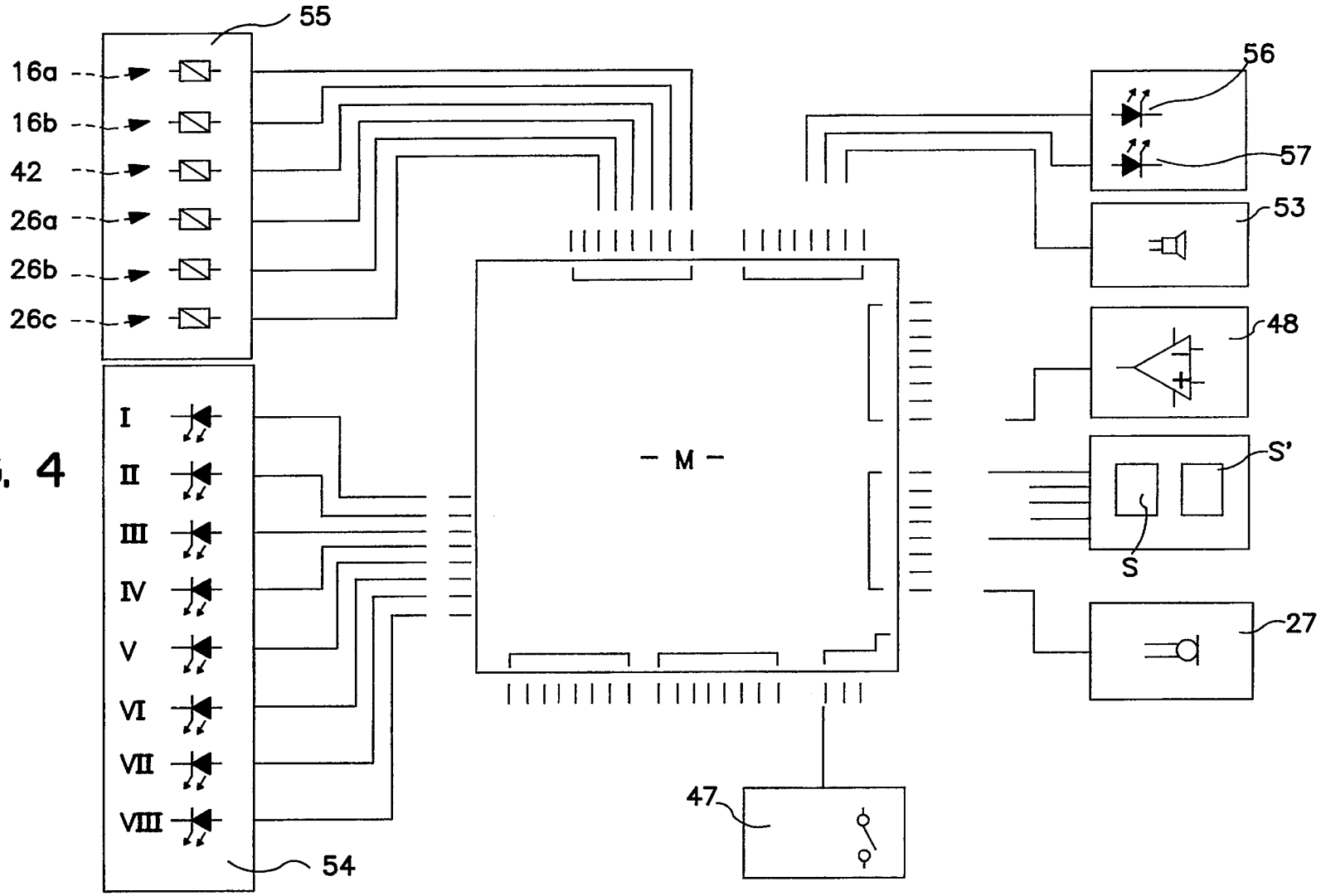

The following description will describe the washing system according to preferred forms thereof and reference will be made to the accompanying drawings in which:

FIG. 1 is an illustration of the washing system according to one embodiment, FIG. 2 is a circuit diagram of one form of the electronic circuitry of a control unit, FIG. 3 is a schematic illustration of the washing system according to a second embodiment, and FIG. 4 is a block diagram of a microprocessor controlled control unit for the arrangement illustrated in FIG. 3.

In the preferred form of the invention the doser unit 10 is a volumetric hydraulic pump and more preferably is a Dosatron (T. M.) pump manufactured by Dosatron International of France. The doser unit 10 comprises a body 11 with an inlet connection 12 and an outlet connection 13. Fluid flowing through the inlet 12 is ported within unit 10 to cause reciprocal movement of a piston inside the unit.

The piston is coupled to a linear actuator shown generally at 14 such that reciprocal movement of the piston causes linear actuator 14 to also reciprocate and pump, on one stroke thereof, a measured quantity of an additive into the fluid passing through the pump 10/14. This additive is sucked into the linear actuator 14 via inlet line 15 upon one stroke of linear actuator 14 and then dispensed into the fluid upon the return stroke of the linear actuator.

According to the present invention the doser unit 10 is coupled to a water supply which will generally be the mains pressure town supply as represented by tap 16. Inlet water passes to doser unit 10 via a shut off valve 17, an inspection valve 18, a pressure switch 19, a back flow preventer 20 and a control solenoid 21. The control solenoid 21 is coupled via pipe 22 to the inlet 12.

Outlet 13 of the doser unit 10 is connected to the delivery lines or equipment to be washed. For example, with in place washing of equipment or delivery lines connection thereto will be via conduit 23.

Cleaning additive from a bulk supply 24 passes through conduit 25 to a control solenoid 26 coupled to line 15.

So as to avoid the need for modification of a proprietary piece of equipment such as the Dosatron volumetric hydraulic pump an external sensing means 27 is coupled to the housing or body thereof. In the preferred form of the invention the sensing means 27 is an acoustic coupler which is connected via connection 28 to a control unit 29.

The control unit 29 is coupled via lines 30 and 32 to control solenoids 21 and 26 respectively and via line 31 to pressure switch 19.

The arrangement as illustrated in FIG. 1 further shows a waste trap 33 located adjacent the outlet of back flow preventer 20 and outlet 34 from control solenoid 26. These are provided for safety purposes and to meet local regulations on possible backflow into water supplies.

With the washing system coupled as shown in FIG. 1 the system can be made operative by actuating start switch 35. The control unit 29 will then control operation of the system through a complete wash cycle, however, if pressure switch 19 detects a reduction in the input water pressure the system will be shut down. Similarly if the power supply fails the system will shut down. Operation will only start by actuating switch 35 again.

The control unit 29 has an external panel which incorporates start switch 35, stop switch 36 and LED's 38 and 39 which respectively "count down" the wash and rinse portions of the cycle. There is also a "finish" LED 40 which indicates a successfully completed wash cycle.

The control unit 29 is coupled via line 37 to a power source, preferably 12vDC.

Referring now to FIG. 2 of the drawings there is shown one form of electronic circuitry for controlling operation of the washing system. The control unit 29 in this form comprises the following sections:

(1) Input amplifier and filter U7

(2) Programmable dividers U4, U5 and U6

(3) Display controller U2

(4) Display driver U1

(5) Start stop control U3.

In operation sound from the changeover toggle in the hydraulic motor of doser unit 10 as detected by acoustics coupler 27 and is amplified and filtered by the input amplifier U7 to a level high enough to trigger the divider stage. The divider stages U4, U5 and U6 are switch selectable for division ratios of 0 to 729 which permits selection of the length of the wash and rinse portions of the washing cycle.

The display controller U2 is an 8 bit shift register initialized to all low outputs. Pulses from the divider chain U4-U5-U6 progressively change the outputs to high state until the end of the washing cycle (i.e. all outputs high).

The display driver U1 drives the display LED's 38 and 39 via current limiting resistors R1–R8.

Initially all inputs are low and are inverted in the device to give a high at the output thus meaning that all the LED's will be on as well as the concentrate solenoid 21 and wash control solenoid 26. As a consequence the doser unit 10 will operate thereby drawing wash concentrate from bulk supply 24 and in accordance with the operation of the doser unit 10 supply metered dosages of the wash concentrate into the water supply for each complete cycle of the linear actuator 14.

Wash progress is indicated by the LED's turning off. Thus with the last of the wash LED's 38 turning off the concentrate solenoid 26 will be shut thereby preventing the addition of further wash concentrate. The doser unit 10 will, however, continue to operate with only water from the supply 16 passing into the delivery line 23. This constitutes the rinse portion of the washing cycle with the result that when the last of LED's 39 turns off the rinse portion of the cycle will be complete with finish LED 40 indicating wash completion.

The start signal is latched by start stop control U3 until the washing cycle is complete or the manual stop 36 is operated.

The washing system is thus readily operable. All that is required of the user is to firstly check that wash concentrate is in the bulk supply 24 and that the supply tap 16.and shut off valve 17 are in the on position. The user then merely operates start switch 35 and leaves the system to complete a full washing cycle. The completion of the washing cycle will be indicated by finish LED 40, however, if washing is interrupted either by operation of the stop switch 36 or the pressure switch 19 the fact that a complete cycle has not taken place will be readily observable from the display LED's. The user then merely has to recommence operation by operation of start switch 35.

While the invention in the embodiment described has particular application for inline washing of supply lines in beverage dispensers found in hotels, bars etc it is not restricted to such end uses and can be readily used or adapted for use in situations where delivery lines are required to be regularly cleaned and maintained in a hygienic state.

For example, the arrangement schematically illustrated in FIG. 3 is particularly suited for in place cleaning of liquid food dispensing equipment such as the internationally available Taylor Dairy Machine such as, for example, the Taylor Combo machine model 8662/8664. The arrangement as illustrated enables both detergent and sanitiser to be dispensed into the cleaning fluid. In addition, however, the washing system provides for the first time a means of in place washing of such equipment without the need for any large scale dismantling of pump(s) and dispensing assemblies. Previous attempts to provide in place washing of such equipment have largely failed due to the inability to clean the seals and sealing surfaces of the pump(s).

In FIG. 3 like elements are identified by the same reference numerals as used in FIG. 1. As the cleaning of such equipment requires heated water hot and cold inputs are provided thereby resulting in two circuits comprising taps 16*a* (hot) and 16*b* (cold), shut off valve 17, inspection valves 18 and backflow preventers 20. In the arrangement as illustrated a solenoid valve 21' is provided in each line.

The outputs from solenoid valves 21' are connected to a pressure control solenoid valve 42 which is in turn connected to a mixing chamber 41. Mixing chamber 41 is coupled via line 22 to the doser unit 10.

Three solenoid valves 26*a*, 26*b* and 26*c* are provided. Solenoid valve 26*a* is coupled via line 43 to a point between the mixing chamber 41 and pressure control valve 42. Solenoid 26*b* is coupled via line 25*b* to a supply of detergent while solenoid 26*c* is coupled via line 25*c* to a supply of sanitiser.

A pressure by pass line 44 is coupled between a manifold 45 (with which solenoid valves 21' and pressure control valve 42 are connected) and the line 46 which connects pressure control valve 42 to the mixing chamber 41. Also connected to line 46 via line 43 is a pressure switch 47 which limits static water pressure to a maximum pressure, e.g. 20 psi.

The solenoid valves 21', 26*a*, 26*b* and 26*c*, pressure control valve 42 and the acoustic coupler 27 are all coupled to control circuitry (not shown) which in one form of the invention includes a microprocessor M. This enables control, sequencing, alarm generation and switch reading to be carried out in accordance with conventional electronic circuitry using microprocessor control. Alternatively a hard wired control circuit similar to that previously described can be employed.

In use conduit 23 is coupled to the pump of the equipment/machine to be washed. In the case of the Taylor Dairy Machine the pump is a coaxial pump and conduit 23 is coupled to the input of the pump after the supply line from the bulk supply of milk product has been removed.

Operation of the washing system commences by pressing a start button S which causes a pre-wash phase (II) to commence. This involves the supply of warm water through the mixing chamber 41 to doser unit 10. This is achieved by controlled switching of solenoid valves 21' such that the temperature of water supplied via doser unit 10 to the machine is gradually increased until, in the preferred form of the invention, it reaches a predetermined temperature at approximately the same time as a predetermined volume of water (as calculated by the control unit counting the movements of the piston in the doser unit 10) has been supplied to the machine. In the preferred form of the invention 20 liters of water is supplied and the temperature reaches 42° C. A temperature sensor 48 forming part of the control circuit is connected into line 22.

Once flushing and heating of the machine has taken place, i.e. pre-wash (II) is complete, the system goes into a wash phase (III). Accordingly solenoid valve **26*b*** is brought into circuit which enables detergent to be added to the water supply as previously described.

According to this form of the invention, however, the solenoid valve **26*b* periodically opens and closes so that a continuous flow of detergent into the water does not occur. However, valve 26*b*** has a total overall open time sufficient to supply a required amount of detergent to achieve a predetermined dosage rate.

Each time valve **26*b* closes solenoid valve 26*a* opens which permits water from line 49 to flow into a manifold 50 (to which valves 26*a*, 26*b* and 26*c* are mounted) to flush the manifold and line 51** leading therefrom to the doser unit.

Once the washing phase (III) has been completed (as determined by a volume of water detected as having passed through—say 20 liters) rinsing with clean water, rinse phase (IV) can take place. This rinse phase can be at a lower temperature (say 30° C.) and a lower volume of say 10 liters.

When the rinse phase is complete a two stage (V) and (VII) sanitizing phase commences. This is achieved by controlled opening and closing of solenoid valve 26 so that sanitizer is added to the water in the same manner as in the wash phase. Sanitizer can be added in a total volume such as to achieve the correct ratio of sanitizer to wash water, e.g. 200 parts per million. Generally this sanitizer stage (V) involves 20 liters of water being supplied to the machine.

At the end of this stage the machine being washed is drained. While this takes place the system goes into a halt mode (VI). Upon the machine being drained a second sanitizer stage (VII) occurs whereby the machine is filled with sanitizer charged water but at a lesser concentration—say 20 ppm.

Once a predetermined volume has been supplied to the machine the sanitizer phase is complete (VIII) as is the full operating cycle of the washing system. It thus now shuts down and is in a ready state (I) whereby a new washing cycle can commence.

One of the major problems with in place washing of equipment of this type is washing of the seals and sealing surfaces within the coaxial pump. When the washing system of the present invention is in operation the machine being washed is also placed in operational mode and as a consequence the coaxial pump operates. However, due to the higher input pressure or flow rate being supplied via conduit 23 the coaxial pump does not provide any pumping action as the washing fluid is actually forced through the equipment being washed.

While the high input pressure via conduit 23 enables the washing fluid to force its way into the seals and sealing areas of the pump(s) full cleaning thereof is not achievable as the seals tend to be forced to one side of the recesses in which they are located. Accordingly the control unit of the washing system is programmed such that the pressure fluctuates (preferably in a controlled manner) between high and low pressures.

This is achieved by pressure control solenoid valve 42 being switched on and off by the control unit. When on the full supply pressure (as limited by pressure switch 47) is applied. When off the flow from manifold 45 takes place via by-pass 44 which being of lesser cross sectional area results in a lower pressure of water supplied to doser unit 10. This lower pressure can be say 5 psi.

As a consequence the controlled change of input pressure via conduit 23 from high to low results in movement of the seals either by friction (in the case of the piston ring of the coaxial pump) or the fluctuating pressure itself (in the case of the O-ring seals on the body of the pump). This enables water to be forced into those areas not accessed when high pressure is being supplied and thereby ensure that all surfaces of the seals/check bands and their locating recesses etc are thoroughly cleaned.

Thus the present system operates to force water through the pump and by fluctuation of pressure total cleaning of the seals and check bands within the coaxial pump can be achieved. Thus while the pump of the machine operates during cleaning it does not function to pump cleaning fluid through the machine. Prior attempts to in place clean such equipment have been concentrated on using the pump(s) of the machine to force the cleaning fluid through the machine but this has still left the problem of needing to separately clean the pump.

In the preferred form of the invention microprocessor control is used. The microprocessor M detects and counts each movement of doser unit 10 thus it can determine that a required volume has passed through and therefore when each phase is complete. This is correlated to other parameters such as temperature. Also conductivity sensors **52*a* and 52*b* can be incorporated with the inlet of each of valves 26*b* and 26*c*. If the conductivity is not within allowable limits this will be detected and the microprocessor will cause the system to go into a halt mode and will cause an alarm 53** to sound.

The microprocessor M also controls a series of LED's one series 54 of which indicate cycle status, i.e. the point in the cycle which is currently in progress and a second series 55 which indicate the switched state of the six solenoid valves.

Sensors can also be coupled to the control unit to detect the level status of the bulk supplies of detergent and sanitizer with the microprocessor causing LED's 56 and 57 to light to show low or critical levels.

The alarm 53 can be controlled by the microprocessor M to indicate end of cycle (as mentioned above) as well as other situations such as the system going into halt mode or incompletion of the pre-wash phase. In the latter instance the system will, upon the alarm sounding, re-set to the beginning of the cycle. The microprocessor can be tone (or other) controlled to provide a distinction between the various alarm states.

The control panel of the system also includes a stop button S' which via a single push thereof enables an operator to move the system into a halt bode (VI). The stop button S' if pushed twice can result in the system resetting to the ready state (I).

The wash in place system according to the invention provides an effective and efficient means of washing the types of equipment and installations referred to.

We claim:

1. A washing system for in place washing of a machine or equipment, the system comprising:

supply means connectable to two sources of washing fluid with one being at a higher temperature than the other, said supply means being controllable to regulate a flow of said washing fluid to the machine or equipment;

means for adding a cleaning additive to the washing fluid; and control means to change the pressure of said flow between a first pressure and a second pressure, wherein said first pressure is higher than said second pressure to control said supply means such that controlled changes in the pressure of the flow of washing fluid to the machine or equipment can be effected, and wherein said supply means includes mixing means controlled by said control means such as to achieve regulation of the temperature of the washing fluid in said flow.

2. The washing system of claim 1, wherein said control means includes at least one solenoid operated valve for controlling the supply of additive and washing fluid.

3. A washing system for in place washing of a machine or equipment, the system comprising:

supply means connectable to two sources of washing fluid with one being at a higher temperature than the other, said supply means being controllable to regulate a flow of said washing fluid to the machine or equipment;

means for adding a cleaning additive to the washing fluid;

control means for controlling the pressure of said flow between a first pressure and a second pressure, wherein said first pressure is higher than said second pressure such that controlled changes in the pressure of said flow of washing fluid to the machine or equipment can be effected; and a doser unit for supply of a metered quantity of cleaning additive to said flow, said doser unit including a sensing means for sensing the operation of the doser unit, wherein said control means disconnects the supply of cleaning additive after a predetermined flow of washing fluid to the machine or equipment.

4. The washing system of claim 3, wherein the control means includes solenoid operated valves for controlling the supply of said additive from at least two sources and the washing fluid.

5. The washing system of claim 4, wherein said sensing means senses the number of operations of said doser unit, said control means disconnecting the supply of said additive after a predetermined number of operations of said doser unit.

6. The washing system of claim 3, wherein said doser unit is a volumetric hydraulic pump.

7. The washing system of claim 6, wherein said sensing means is an acoustic coupler coupled to the external wall surface of the body of said doser unit.

8. A washing system for in place washing, the system comprising:

a doser unit coupled to a washing fluid supply, said doser unit further coupled to a cleaning additive supply, wherein said cleaning additive supply has means for the supply of a metered quantity of cleaning additive to the doser unit;

sensing means including an external sensor coupled to the doser unit for in-use sensing of the number of operations of the doser unit when said doser unit is metering cleaning additive into the washing fluid supply; and control means for causing disconnection of the cleaning additive supply from the doser unit after a predetermined number of operations of the doser unit has been sensed by said sensing means.

9. The washing system of claim 8, wherein the doser unit is a volumetric hydraulic pump.

10. The washing system of claim 9, wherein the sensor is an acoustic coupler.

11. The washing system of claim 10, wherein said control means includes a regulating means for regulating the temperature of the said washing fluid issuing from said doser unit.

12. The washing system of claim 8, further comprising a pressure regulating means for regulating the pressure at which said washing fluid issues from said doser unit.

13. The washing system of claim 12, wherein said control means further includes a pressure adjusting means to control a fluctuating pressure of said washing fluid.

* * * * *